United States Patent [19]

Crowe et al.

[11] 4,081,181

[45] Mar. 28, 1978

[54] DISCRIMINATOR SUPPORTING ASSEMBLY

[75] Inventors: Norman P. Crowe, Miami Township, Clermont County; Joseph M. Lohse, Terrace Park, both of Ohio

[73] Assignee: Multifold-International, Inc., Milford, Ohio

[21] Appl. No.: 759,711

[22] Filed: Jan. 5, 1977

[51] Int. Cl.[2] ..... B65H 1/30; B65H 3/04

[52] U.S. Cl. ..... 271/3.1; 214/8.5 G; 271/35; 271/165; 271/167

[58] Field of Search ..... 271/3.1, 35, 221, 222, 271/165, 167, 124, 138, 37, 166, 171; 214/8.5 G, 8.5 B; 198/423, 443, 462

[56] References Cited

U.S. PATENT DOCUMENTS

| | | | |
|---|---|---|---|
| 1,637,833 | 8/1927 | Mueller | 271/124 |
| 3,194,126 | 7/1965 | Larsson | 271/221 X |
| 3,905,490 | 9/1975 | Johnson | 271/3.1 X |
| 3,952,882 | 4/1976 | Molitor | 271/3.1 X |

*Primary Examiner*—Bruce H. Stoner, Jr.

*Attorney, Agent, or Firm*—James W. Pearce; Roy F. Schaeperklaus

[57] ABSTRACT

A discriminator supporting assembly for a discriminator plate which is mounted above a conveyor belt course. The assembly includes a lengthwise adjustment screw for moving the discriminator plate lengthwise of the conveyor belt toward and away from patter members, an upright adjustment screw for moving the discriminator plate toward and away from the conveyor belt course, and a plate swinging adjustment screw for swinging the discriminator plate with relation to the plane of the conveyor belt course.

4 Claims, 5 Drawing Figures

DISCRIMINATOR SUPPORTING ASSEMBLY

BACKGROUND OF THE INVENTION

This invention relates to a machine for handling streams of flat articles. More particularly, this invention relates to a discriminator assembly for such a machine.

An object of this invention is to provide a discriminator assembly having a discriminator plate which can be moved with respect to a belt conveyor that removes articles from the bottom of a stack in a shingle configuration and with respect to patter members which are spaced therefrom.

A further object of this invention is to provide such a discriminator assembly in which the discriminator plate can be moved lengthwise of the belt conveyor and also toward and away from the belt conveyor.

A further object of this invention is to provide such a discriminator assembly in which the discriminator plate is mounted for swinging with respect to the conveyor belt.

A further object of this invention is to provide a combined conveyor and discriminator assembly which feeds flat articles from a stack in a smooth, even shingle.

SUMMARY OF THE INVENTION

Briefly, this invention provides a discriminator assembly which supports a discriminator plate above a sloping conveyor belt course and spaced from patter members to define a hopper space in which flat articles form a stack. The discriminator plate forms a stop for articles projected into the hopper space. The discriminator plate can be moved lengthwise of the conveyor belt toward and away from the patter members by actuation of first control mechanism of the discriminator assembly; the discriminator plate can be moved toward and away from the conveyor belt course by actuation of second control means of the discriminator assembly; and the discriminator plate can be swung with relation to the plane of the conveyor belt course by actuation of third control mechanism of the discriminator assembly. The conveyor belt withdraws the articles from the stack under the discriminator plate in a shingle configuration.

BRIEF DESCRIPTION OF THE DRAWINGS

The above and other objects and features of the invention will be apparent to those skilled in the art to which this invention relates from the following detailed description and the drawings, in which.

DESCRIPTION OF THE PREFERRED EMBODIMENT

Figure 1:
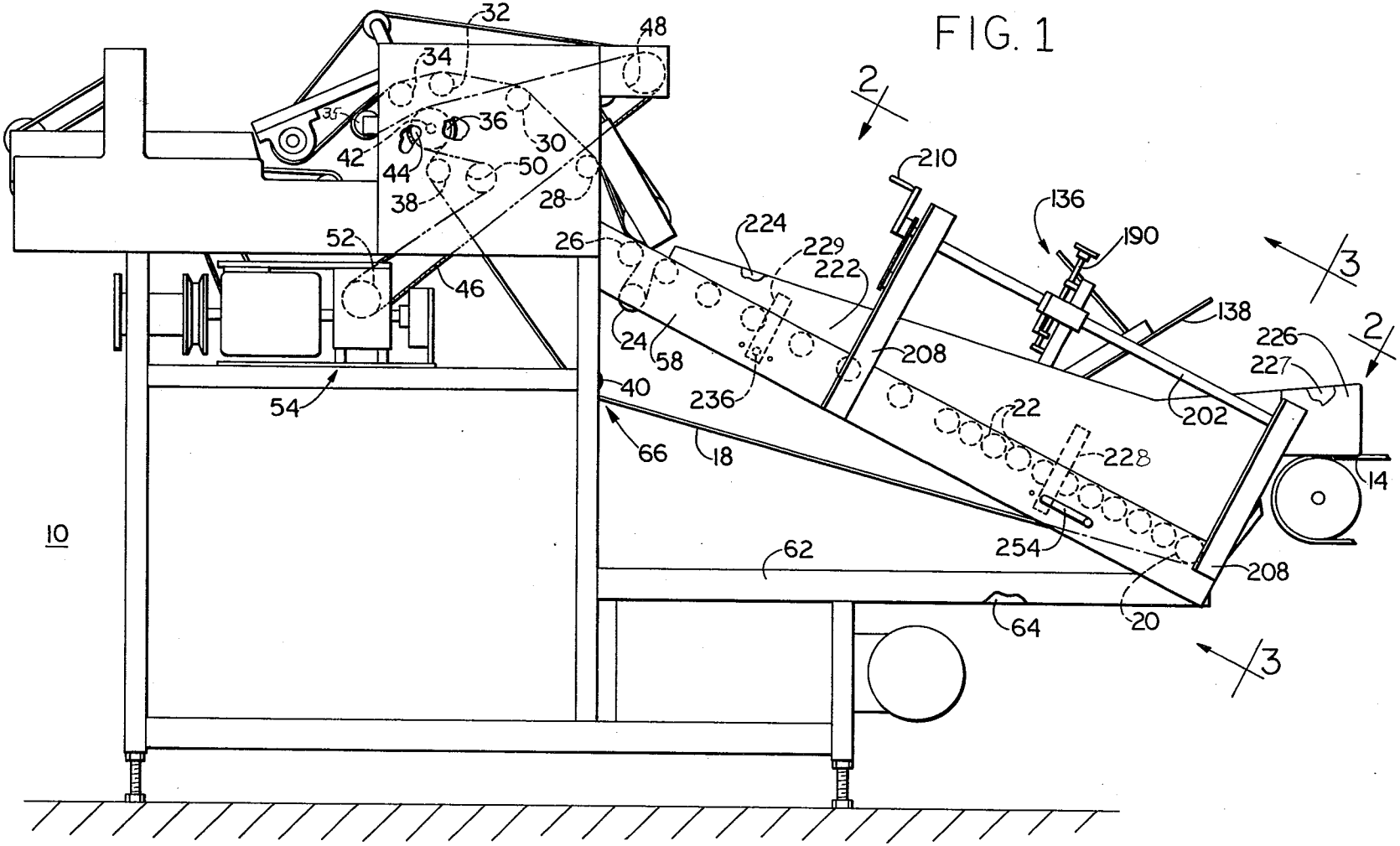
FIG. 1 is a somewhat schematic view in side elevation of a carton packing machine which includes a discriminator assembly constructed in accordance with an embodiment of this invention.

In the following detailed description and the drawings, like reference characters indicate like parts.

Figures 4, 5:
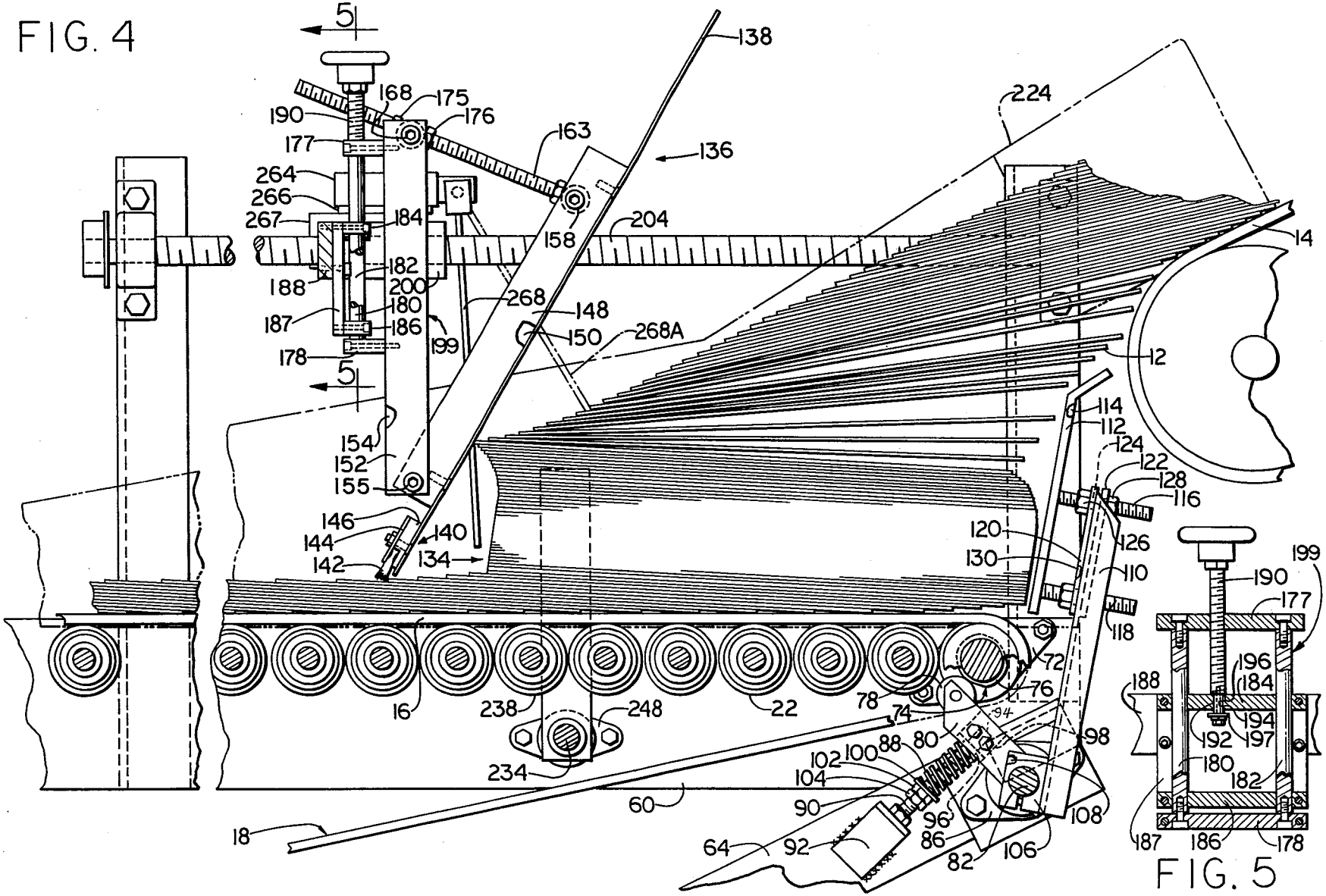
FIG. 4 is a view in section taken on the line 4—4 in FIG. 2.
FIG. 5 is a view in section taken on the line 5—5 in FIG. 4.

In FIG. 1 is shown a machine 10 which handles flat articles 12 (FIG. 4). The articles are delivered to the machine 10 by a feed conveyor 14. The articles 12 fall from the feed conveyor 14 onto a sloping course 16 of a conveyor belt 18. The conveyor belt 18 runs on an entry pulley 20 and a plurality of guide pulleys 22 (FIG. 4) which guide and support the sloping course 16 for travel along a plane which slopes upwardly and to the left as shown in FIG. 1. The conveyor belt 18 then travels on pulleys 24, 26, 28, 30, 32, 34, 35, 36, 38 and 40. The pulley 36 is a drive pulley and is mounted on a shaft 42 which is rotatably mounted in bearings (not shown). A sprocket 44 is also mounted on the shaft 42. The sprocket 44 is driven by a chain 46, which runs on idler sprockets 48 and 50, and a drive sprocket 15. The chain 46 is driven by appropriate drive mechanism 54, not shown in detail.

Figure 2:
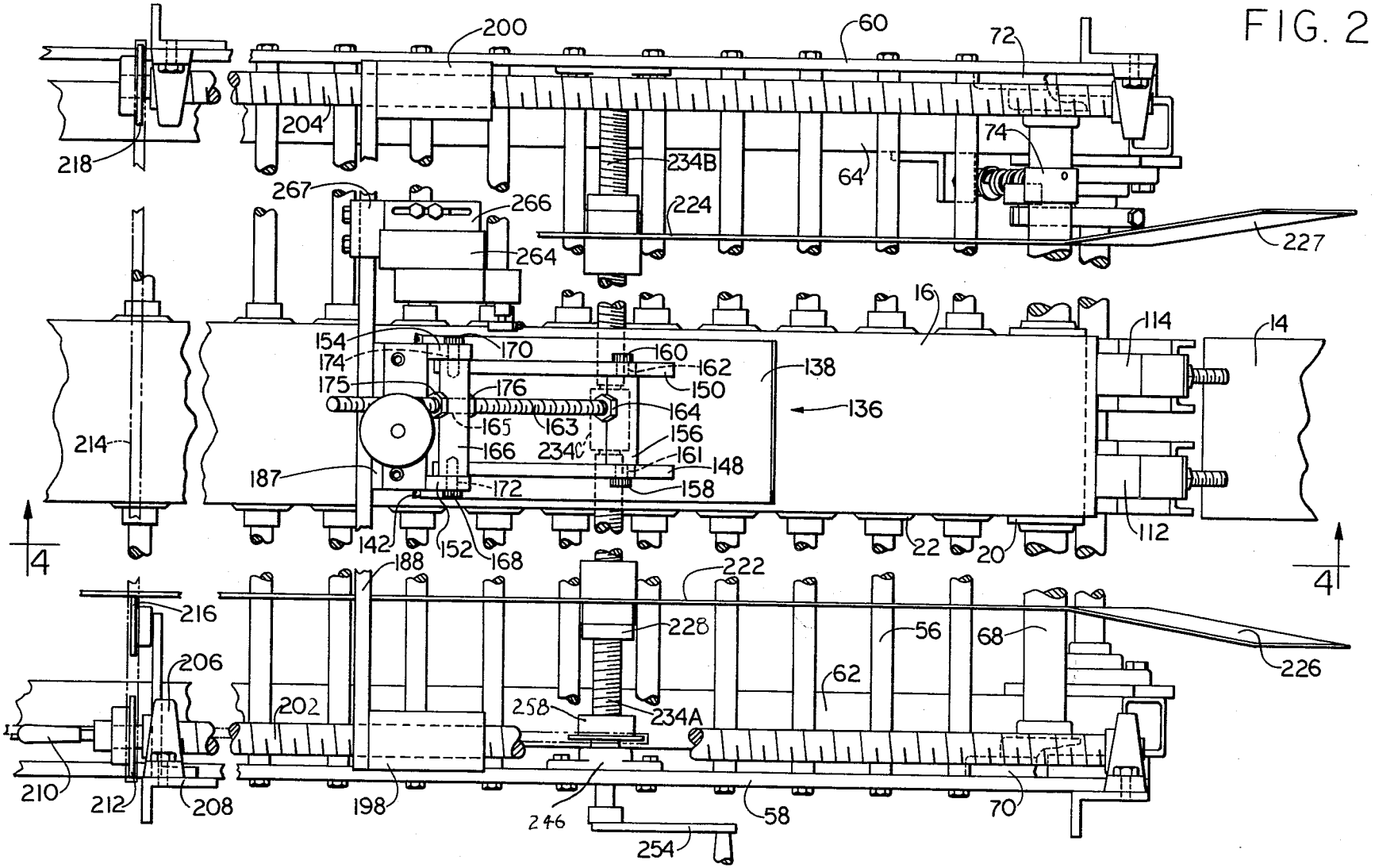
FIG. 2 is an enlarged view looking in the direction of the arrows 2—2 in FIG. 1.

Each of the guide pulleys 22 is rotatably mounted on a shaft 56 (FIG. 2). Each of the shafts 56 is mounted between and spans side plates 58 and 60. The side plates 58 and 60 are mounted on cantilever frames 62 and 64, respectively, and extend upwardly and to the left as shown in FIG. 1 to a main framework 66.

Figure 3:
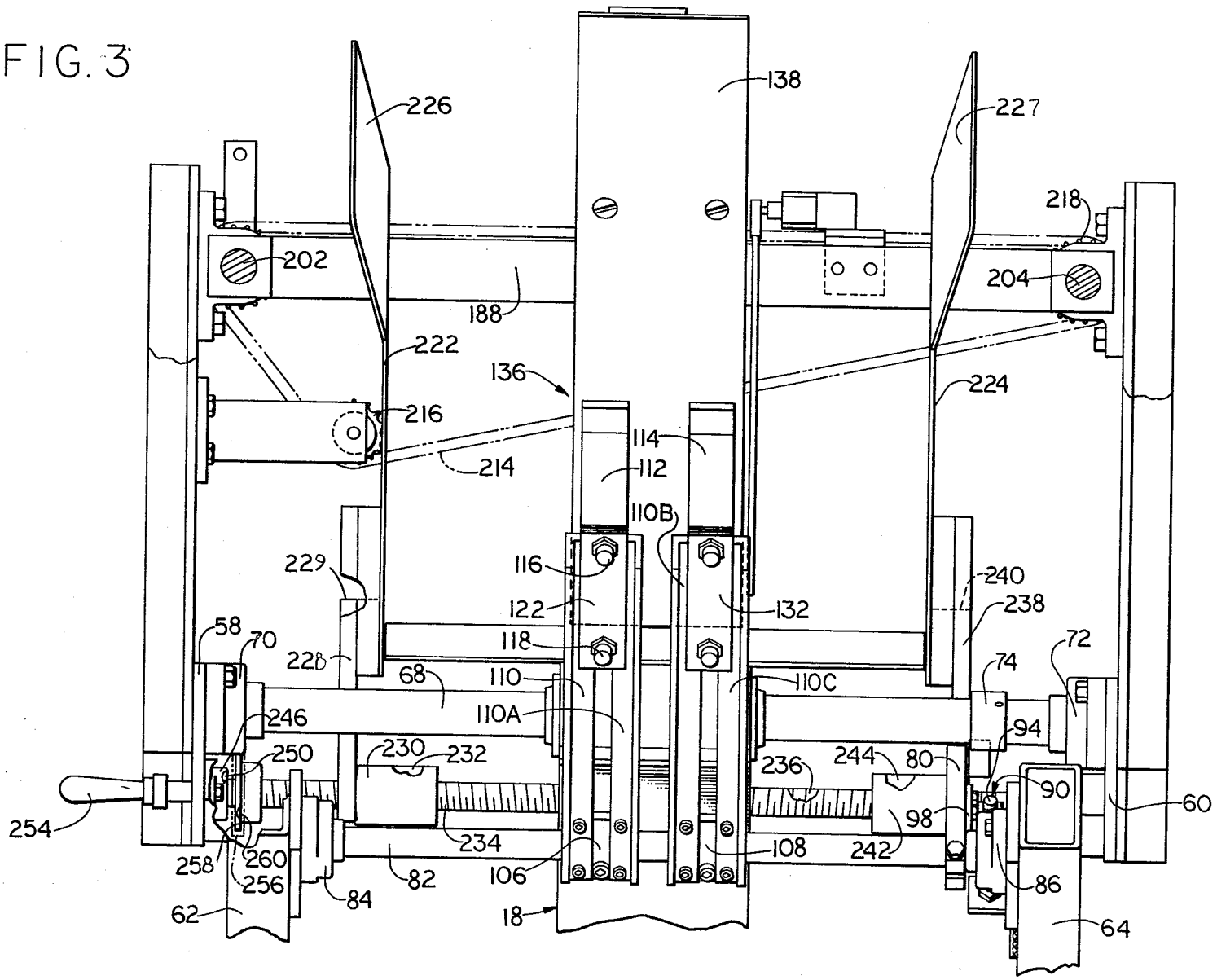
FIG. 3 is an enlarged view partly in elevation and partly in section taken generally on the line 3—3 in FIG. 1, parts being broken away to reveal details of construction.

The entry pulley 20 is mounted on a shaft 68. The shaft 68 is rotatably mounted in bearings 70 and 72 (FIG. 3) mounted on the side plates 58 and 60, respectively. The shaft 68 carries a cam 74 having a pair of opposed lobes 76 (FIG. 4). The cam 74 actuates a cam follower roller 78 and a crank arm 80, on which the cam follower roller 78 is mounted. The crank arm 80 is mounted on a shaft 82, which is rotatably mounted in bearings 84 and 86 (FIG. 3). The bearings 84 and 86 are mounted on the cantilever frames 62 and 64, respectively. A compression spring 88 (FIG. 4) resiliently holds the crank arm 80 in a position where the cam follower roller 78 is in engagement with the cam 74. The spring 88 is mounted on a threaded guide pin 90. The guide pin 90 is mounted on an angle shaped bracket 92, which is attached to the cantilever frame 64. A head end 94 of the guide pin 90 extends through a guide opening 96 in an angle shaped guide 98 mounted on the crank arm 80. The spring 88 bears on the angle shaped guide 98 and on a stop washer 100, which is mounted on the guide pin 90 and held in position thereon by nuts 102 and 104. Patter clamps 106 and 108 (FIGS. 3 and 4) are mounted on the shaft 82. Angle shaped patter frames 110, 110A, 110B and 110C are mounted on the clamps 106 and 108. Patter members 112 and 114 are supported by the patter frames 110, 110A, 110B and 110C. The patter member 112 carries a pair of spaced parallel studs 116 and 118. Clamp plates 120 and 122 are mounted on the studs 116 and 118 with the studs 116 and 118 passing through clear holes 124 in the clamp plates 120 and 122. Nuts 126 and 128 mounted on the studs 116 and 118 cause the clamp plates 120 and 122 to engage inwardly directed flanges of the patter frames 110 and 110A. The patter member 114 is similarly mounted by means of clamp plates 130 and 132. The patter members 112 and 114 swing back and forth to pat rear edges of the articles 12 into alignment as the shaft 68 and the pulley 20 turn to turn the cam 74. Since the cam 74 has two lobes 76 (FIG. 4), the patter members swing back and forth twice for each turn of the pulley 20.

The articles 12 form a stack 134 as they are patted by the patter members 112 and 114. The sloping course 16 of the conveyor belt 18 draws the articles to the left from the bottom of the stack 134, as shown in FIG. 4, in a shingle configuration. A discriminator assembly 136 evens the level of the shingle. The discriminator assembly includes a discriminator plate 138, which is in the path of articles 12 leaving the feed conveyor 14. The discriminator plate 138 slopes downwardly and to the left to a foot portion 140. A brush 142 is mounted on the foot portion 140. A clamp plate 144 and a brush spacer member 146 are mounted on the foot portion 140 of the discriminator plate 138 and hold the brush 142 in position thereon. Rib members 148 and 150 are mounted on an upper face of the discriminator plate 138. Lower end portions of the rib members 148 and 150 are pivotally connected to upright bar members 152 and 154, respectively by fasteners 155, only one of which is shown. Upper end portions of the rib members 148 and 150 are spanned by a cross bar 156 (FIG. 2). The cross bar 156 is mounted on fastener members 158 and 160 which extend through clear holes 161 and 162 in the rib members 158 and 160, respectively, and are received in axial bores (not shown) in the cross bar 156. A threaded rod 163 is mounted in a radial bore (not shown) in the cross bar 156 and locked in place therein by a nut 164. The threaded rod 163 extends through a clear hole 165 in a cross bar 166. The cross bar 166 is mounted between the upright bar members 152 and 154. Fasteners 168 and 170 extend through clear holes 172 and 174 in the upright bar members 152 and 154, respectively, and are received in axial bores in the cross bar 166. Nuts 175 and 176 mounted on the threaded rod 163 can be turned to adjust the spacing of the cross bars 156 and 166 and to adjust the angle of slope of the discriminator plate 138.

The upright bar members 152 and 154 are mounted on cross bars 177 and 178. The cross bars 177 and 178 are spanned by upright guide rods 180 and 182. The guide rods 180 and 182 are slidably mounted for up and down movement in cross bars 184 and 186. The cross bars 184 and 186 are mounted on a plate 187 and are supported by a transverse bar 188. An upright adjustment screw 190 is threaded in the cross bar 177. A lower end portion 192 (FIG. 5) of the upright adjustment screw 190 is rotatably mounted in an upright bore 194 in the cross bar 184. An annular shoulder 196 on the upright adjustment screw 190 bears on an upper face of the cross bar 184 so that the height of the discriminator assembly 136 can be adjusted by turning of the upright adjustment screw 190. A washer 197 mounted on the lower end portion 192 holds the screw 190 and the cross bar 184 in assembled relation.

The assembly of the upright bar members 152 and 154, the cross bars 177 and 178 and the upright guide rods 180 and 182 forms an elongated upright bracket 199 which is mounted on the transverse bar 188 for movement toward and away from the conveyor 16. The fasteners 155 form means pivotally connecting first support means on the upright bracket 199 with first support means on the discriminator plate. The fastener 168 and 170 form means pivotally connecting the cross bar 166 with second support means on the upright bracket 199, which are spaced from the first support means on the upright bracket. The fasteners 158 and 160 form pivot means for for second support means on the discriminator plate spaced from the first support means on the dircriminator plate.

End portions of the transverse bar 188 are carried by adjustment screw nuts 198 and 200 (FIG. 2), which are threaded on lengthwise adjustment screws 202 and 204, respectively. The lengthwise adjustment screws 202 and 204 are rotatably mounted in bearings 206 carried by posts 208 which, in turn, are mounted on the side plates 58 and 60. A crank 210 is mounted on the lengthwise adjustment screw 202, as shown in FIGS. 1 and 2. A sprocket 212 mounted on the lengthwise adjustment screw 202 drives a chain 214. The chain 214 runs on an idle sprocket 216 and on a sprocket 218 mounted on the lengthwise adjustment screw 200 so that, when the crank 210 is turned, the adjustment screw nuts 198 and 200 advance in unison and the transverse bar 188 is moved lengthwise of the conveyor belt course 16 together with the discriminator assembly 136.

The articles being delivered by the feed conveyor 14 are guided by elongated side guides 222 and 224 (FIGS. 1 and 2). End portions 226 and 227 of the side guides 222 and 224 converge on opposite sides of the feed conveyor 14 to guide the articles into alignment with the conveyor belt course 16. Main portions of the side guides 222 and 224 are parallel. The side guide 222 is mounted on posts 228 and 229. The posts 228 and 229 are carried by transverse adjustment screw nuts 230 and 232 (FIG. 3) which run on transverse adjustment screw members 234 and 236, respectively. The side guide 224 is similarly mounted on posts 238 and 240 carried by transverse adjustment screw nuts 242 and 244 which run on the transverse adjustment screw members 234 and 236, respectively. The transverse adjustment screw member 234 is rotatably mounted in bearings 246 and 248 (FIGS. 3 and 4) mounted on the side plates 58 and 60, respectively. The transverse screw member 234 includes a first section 234A (FIG. 2) and a second section 234B which are connected together in axially aligned relation by a connector 234C. Threads of the sections 234A and 234B are of opposite hand so that, when the transverse adjustment screw member 234 is turned, the transverse adjustment screw nuts 230 and 242 move toward and away from the center line of the conveyor belt course 16 in unison. The transverse adjustment screw 236 is similarly constructed and similarly mounted in bearings 250, only one of which is shown, mounted on the side plates 58 and 60. A crank 254 is mounted on the transverse adjustment screw 234. A chain 256 runs on sprockets 258 and 260 mounted on the transverse adjustment screw members 234 and 236, respectively, to cause the transverse adjustment screw members 234 and 236 to turn in unison so that, when the crank 256 254 turned, the guides 222 and 224 are caused to move in or out together.

A limit switch 264 (FIGS. 2 and 4) is supported on a bracket plate 266. The bracket plate 266 is mounted on an angle shaped member 267 mounted on the transverse bar 188. A switch actuator arm 268 of the limit switch 264 hangs downwardly into the path of the articles 12.

The conveyor belt course 16 slopes upwardly to the left as shown in FIGS. 4 and 1 from the patter members 112 and 114 to the discriminator plate 138. The angle between the conveyor belt course 16 and the horizontal can be sufficient that the articles 12 automatically form a shingle configuration as the articles 12 are withdrawn from the bottom of the stack 134 by the conveyor belt course 16 in the absence of a tendency of the articles to stick together. The angle can be approximately 20 to 30 degrees when the articles are in the nature of flattened containers for packaged detergent or the like. The patter members pat rear edges of the articles in the stack 134 into alignment to free each of the articles from articles on opposite sides thereof. The discriminator plate 138 can be set to slope upwardly from the conveyor belt course 16 and toward the patter members 112 and 114 with relation to the plane of the belt conveyor course 16 such that, if a pair of adjacent articles stick together even after being patted into aligned position by the patter members 112 and 114, as the articles are advanced by the conveyor belt course 16, the upper article in the pair hits the discriminator plate 138 before the lower article of the pair so that the discriminator plate causes separation of the articles of the pair to insure a smooth shingle formation of the stream of articles leaving the discriminator plate 138.

The mounting arrangement of the discriminator assembly 136 makes it possible to precisely position the discriminator plate 138. The angle between the discriminator plate 138 and the sloping course 16 of the conveyor belt 18 can be adjusted by turning the nuts 175 and 176. The height of the discriminator plate 138 above the conveyor belt course 16 can be adjusted by turning the upright adjustment screw 190. The spacing between the patter members 112 and 114 and the discriminator plate 138 can be adjusted by turning the crank 210. The space defined by the dicriminator plate 138, the conveyor belt 18, the patter members 112 and 114 and the side guides 222 and 224 acts as a hopper on which the stack 134 is formed, and the size and configuration of this hopper space can be adjusted by adjusting the position of the discriminator plate 138. The operation of the conveyor belt 18 can be controlled by the limit switch 264. For proper operation, there should be articles in the stack 134 at all times. If the stack 134 is substantially exhausted, the switch actuator arm 268 can swing to the dot-dash position indicated at 268A in FIG. 4. The limit switch 264 can be connected to stop the operation of the drive mechanism when the switch actuator arm is in the position 268A.

The discriminator mounting assembly described above and illustrated in the drawings is subject to structural modification without departing from the spirit and scope of the appended claims.

What is claimed is:

1. In combination with a conveyor belt and a discriminator plate overlying the conveyor belt, a discriminator supporting assembly which comprises lengthwise adjustment screw means extending lengthwise of the conveyor belt, a transverse mounting bar mounted on the lengthwise adjustment screw means and overlying the conveyor belt and advanceable along the lengthwise adjustment screw means, an elongated upright bracket mounted on the transverse mounting bar for movement toward and away from the conveyor belt, upright adjustment screw means connecting the transverse mounting bar and the bracket, spaced first and second support means mounted on the upright bracket, spaced first and second support means on the discriminator plate, means pivotally connecting the first support means of the upright bracket to the first support means on the discriminator plate, and plate swinging adjustment screw means connecting the second support means of the upright bracket to the second support means of the discriminator plate, whereby actuation of the lengthwise adjustment screw means advances the discriminator plate lengthwise of the conveyor belt, actuation of the upright adjustment screw means advances the discriminator plate toward and away from the conveyor belt, and actuation of the plate swinging adjustment screw means swings the discriminator plate with respect to the conveyor belt.

2. A combination as in claim 1 wherein the plate swinging adjustment screw means comprises a first screw support member pivotally mounted on the second support means of the upright bracket and a second screw support member pivotally mounted on the second support means of the discriminator plate, a threaded rod extending between the screw support members, means for attaching the threaded rod to one of the screw support members and means engageable with the other screw support member and advanceable along the threaded rod for actuation of the plate swingng adjustment screw means.

3. An assembly for supporting a discriminator plate in spaced relation to a conveyor belt which comprises lengthwise adjustment screw members extending lengthwise of and rotatably mounted on opposite sides of the conveyor belt, lengthwise adjustment nuts traveling on the lengthwise adjustment screw members, a transverse mounting bar mounted on the lengthwise adjustment nuts and overlying the conveyor belt, an elongated upright bracket mounted on the transverse mounting bar for movement toward and away from the conveyor belt, upright adjustment screw means connecting the transverse mounting bar and the bracket, spaced first and second support means mounted on the upright bracket, spaced first and second support means mounted on the discriminator plate, means pivotally connecting the first support means of the upright bracket to the first support means on the discriminator plate, and plate swinging adjustment screw means connecting the second support means of the upright bracket to the second support means of the dicriminator plate, whereby actuation of the lengthwise adjustment screw members advances the discriminator plate lengthwise of the conveyor belt, actuation of the upright adjustment screw means advances the discriminator plate toward and away from the conveyor belt, and actuation of the plate swinging adjustment screw means swings the discriminator plate with respect to the conveyor belt.

4. A combination as in claim 3 wherein the plate swinging adjustment screw means comprises a first screw support member pivotally mounted on the second support means of the upright bracket and a second screw support member pivotally mounted on the second support means of the discriminator plate, a threaded rod extending between the screw support members, means for attaching the threaded rod to one of the screw support members and means engageable with the other screw support member and advanceable along the threaded rod for actuation of the plate swinging adjustment screw means.

* * * * *